United States Patent [19]

Shafer

[11] 4,168,162

[45] Sep. 18, 1979

[54] INFILTRATING POWDER COMPOSITION

[75] Inventor: William M. Shafer, Crown Point, Ind.

[73] Assignee: SCM Corporation, New York, N.Y.

[21] Appl. No.: 944,852

[22] Filed: Sep. 22, 1978

[51] Int. Cl.[2] ..... B22F 3/26; C22C 9/00

[52] U.S. Cl. ..... 75/252; 75/208 R; 75/255

[58] Field of Search ..... 75/208, 252, 255

[56] References Cited

U.S. PATENT DOCUMENTS

| | | | |
|---|---|---|---|
| 2,401,221 | 5/1946 | Bourne | 75/125 |
| 3,301,673 | 1/1967 | Bridwell et al. | 75/153 |
| 3,307,924 | 3/1967 | Michael | 75/153 |
| 3,619,170 | 11/1971 | Fisher | 75/252 |
| 3,652,261 | 3/1972 | Taubenblat | 75/252 |

*Primary Examiner*—W. Stallard

*Attorney, Agent, or Firm*—Thomas M. Schmitz

[57] ABSTRACT

An infiltrating powder composition for infiltrating porous iron compacts comprises a copper powder mixture containing a minor amount iron powder, copper-maganese alloy powder, stainless steel powder, refractory metal oxide, and aluminum powder.

3 Claims, No Drawings

INFILTRATING POWDER COMPOSITION

BACKGROUND OF THE INVENTION

This invention pertains to a copper based powder mixture for infiltrating a porous mass of ferrous material whereby a clean, erosion-free infiltrated iron compact can be produced.

The strength of iron powder compacts can be increased by infiltrating the compacted powder iron matrix with a metal having a melting point lower than that of iron. The lower melting infiltrant is placed on the surface of the iron compact in the amount sufficient to fill the voids in the compacted iron matirx upon heating to a temperature sufficient to melt the infiltrant. The resulting mass is often heated to a temperature sufficient to sinter the iron as well as melting the infiltrant and such a process is known in the art as "sintration" or sintrating. The resulting infiltrated compact has a final strength greater than that of a non-infiltrated iron powder compact. Infiltrating processes for iron base compacts ordinarily provide copper infiltrating powder, iron or other metal to reduce erosion of the iron compact, and a refractory parting compound to facilitate removal of residue remaining after infiltration. The infiltrating composition is usually preformed into a slug which is then placed on the iron compact for filtrating.

Various infiltrating compositions suggested in the past, however, very often leave a residue which adheres to the infiltrated compact. The residue often sticks to the infiltrated part and must be chipped or ground off after the infiltration is completed. U.S. Pat. No. 2,401,221 suggests a simple copper mixture containing a minor amount of iron powder although removal of excess iron residue remains a problem. Erosion of the infiltrated compact is a further problem due to iron from the compacted iron matrix being dissolved by copper. Hardening compounds or refractories such as magnesium oxide or titanium dioxide are incorporated into the infiltrating composition for the purpose of releasing a residue left behind from the infiltrating composition. For example, U.S. Pat. No. 3,307,924 suggests an infiltrate composition preformed into a slug that leaves a residue which shrinks and warps into a husk-like residue which may be easily removed from the infiltrated part; whereas, U.S. Pat. No. 3,619,170 suggests the inclusion of minor amounts of iron-chromium alloy within the infiltrating composition which substantially reduces the tendency of such residues to adhere and/or erode the infiltrated metal compact whereby the remaining residue can be removed by a gravitational force. U.S. Pat. No. 3,652,261 suggests a copper prealloy containing as essential alloying elements along with iron manganese, aluminum and nickel. Prealloyed copper materials however, exhibit low compressability and low green strength. Also, pre-alloyed materials do not contain refractory metal oxides which aid in the separation of the residue from the infiltrated iron part. Alloyed materials rely upon in-situ formation of refractory or metal oxide during the infiltrating process, but such materials are very sensitive to the furnace atmosphere, the dew point of the furnace atmosphere, and the infiltrating temperature since the amount of oxide formed is sensitive to these parameters.

It now has been found that a copper infiltrating powder containing certain minor amounts of admixed powders of iron, copper-manganese alloy, stainless steel, and aluminum, improve the infiltrated iron compact by avoiding residue adhesion, migration or soiling, improving efficiency, and avoiding erosion of the compact. The resulting infiltrated compact exhibits improved strength and better hardness as well as controlled density and dimensional changes.

SUMMARY OF THE INVENTION

An infiltrating composition for strengthening porous ferrous metal materials comprising a powder metal mixture containing predominantly copper powder and minor amounts of iron powder, copper-manganese alloy, refractory oxide, stainless steel powder, and aluminum powder. The powder mixture can contain minor amounts of oil to stabilize the uniform mixture of powder and minimize dusting and segregation of materials due to density differential during handling.

DETAILED DESCRIPTION OF THE INVENTION

The copper powder metal is elemental copper powder having a particle size up to about 177 microns (−80 mesh) and 105 microns (−150 mesh). The copper powder can be produced by reduction of copper oxide, or by electrolysis or by atomization. Atomization of copper, for example, is disclosed in U.S. Pat. No. 2,956,304 wherein water is utilized as an atomizing medium although inert liquid hydrocarbons or gas atomization processes may be utilized. The infiltrating composition contains elemental copper powder on a weight basis of at least about 85% and preferably greater than 90%.

The iron powder consists of iron particles having an average particle size up to about 20 microns, desirably less than 10 microns, and preferably less than about 5 microns. Iron particles beyond about 20 microns present compounding problems such as providing copper solution of iron. The carbonyl iron particles effectively satisfy the dissolving power of copper for iron during infiltration so that even the initial copper entering the iron compact will not erode the infiltration surface of the iron compact. Erosion occurs when molten copper dissolves iron from the iron compact. The infiltrating composition contains by weight between about 2% and 8%, and preferably between about 3% and 5%, iron powder.

The infiltrating composition further contains a copper-manganese alloy powder containing approximately a 66/33 weight ratio of copper to manganese and broadly between 60 to 70 weight parts copper and 40 to 30 weight parts of manganese. The copper-manganese alloy can contain up to about 1.5% silicon. The alloy powder can be produced by water atomization in the manner disclosed in U.S. Pat. No. 2,956,304. Other methods include gas atomization or mechanical comminution. The infiltrating composition contains between about 1% and 5% of said alloy.

The infiltrating composition further contains a minor amount of a refractory material such as titanium dioxide powder which will not oxidize iron and/or copper at high temperatures above about 2300° F. Infiltration ordinarily takes place at temperatures of about 2100° F. Standard titanium dioxide powder is about 0.2 microns. The infiltrating composition contains between about 0.4% and 1% titanium dioxide powder on a weight basis of the infiltrating powder composition is satisfactory.

The infiltrating composition further contains between about 0.3% and 0.8% stainless steel powder. For best results, the stainless steel powder should be about −100 mesh or less than about 150 microns. The stainless steel powder can be conventional stainless steel and produced from chromium steel alloy by atomization to obtain the desired fine particle size.

The infiltrating composition can contain between about 0.05 and 0.2%, and preferably about 0.1% of aluminum powder. The aluminum powder is about −325 mesh and less than about 44 microns. Aluminum powder can be produced by atomization. Other useful components in the infiltrating composition are graphite (0.1 to 0.5%), zinc stearate (0.2% to 0.9%), and light blending oil for loosely binding the dry metal powders to minimize dusting and segregation of the uniformly mixed powders. The infiltrating composition can be admixed with about 5 to 10 milliliters of light oil per 100 pounds of metal powders.

In practice, the infiltrating composition of this invention can be contacted with the porous ferrous workpiece and thereafter heated to sufficiently raise the temperature of the infiltrating composition to cause the infiltrant material to infiltrate the porous iron compact and fill the voids in the iron compact. Infiltration can be carried out at temperatures slightly above the melting point of copper, that is about about 1,980° F., and preferably between about 2,000° F. to 2,350° F. Temperatures greater than 2,350° F. may cause molten copper to rapidly increase the dissolving of iron. The tendency of molten copper to dissolve iron will cause excessive erosion of the powder iron compact. A one-step infiltration and sintering process, for example, can be achieved in about 15 minutes at 2,050° F. Desirably, infiltration takes place in an inert or reducing atmosphere. Reducing atmospheres, for example, include hydrogen, cracked ammonia and endothermic atmosphere, whereas suitable inert gases are nitrogen, argon, and the like.

A major advantage of this invention is that the infiltrating composition produces a non-sticking residue over a wide range of dew points from about 30° F. to 50° F. when used in an endothermic atmosphere whereby the residue no longer has to be chipped or ground off after infiltration. Broadly, the infiltrating material of this invention can be utilized for simultaneous infiltration and sintering at temperatures of about 2,000° to 2,100° F. in an endothermic atmosphere at a dew point between about 0° and 65° F.

The following examples illustrate preferred modes of this invention but should not be construed as limiting. All parts and percentages recited in the examples are by weight and all temperatures are in degrees Fahrenheit unless otherwise specifically stated.

EXAMPLE I

Infiltrating compositions produced in accordance with this invention are as follows. Percentages are weight %.

| Material | Sample C | Sample H |
|---|---|---|
| Copper powder* | 90.7% | 90.7% |
| Iron powder (−325 mesh) | 4.0% | 4.0% |
| Copper-manganese (40/60) | 2.8% | |
| Copper-manganese-silicon (33/65.6/1.4) | | 3.2% |
| Titanium dioxide (−80 mesh) | 0.7% | 0.7% |
| Stainless steel (−100 mesh) | 0.5% | 0.5% |
| Zinc stearate | 0.5% | 0.5% |
| Graphite | 0.3% | 0.3% |
| Aluminum powder | 0.1% | 0.1% |
| Rubrex light blending oil | 6 ml/100 lb. | 6 ml/100 lb. |

-continued (SG = 0.854 gm/cc)

| *Sieve | Analysis | Tyler % |
|---|---|---|
| −80 | +100 | trace |
| −100 | +150 | 0.5 |
| −150 | +200 | 15.4 |
| −200 | +325 | 34.8 |
| −325 | | 49.3 |

The foregoing infiltrating composition samples had the following characteristics.

| | Sample C | Sample H |
|---|---|---|
| Apparent density | 3.24 gm/cc | 3.26 gm/cc |
| Flow rate | 33 sec/50g | 31 sec/50g |
| Green density, compressed | | |
| at 12 tsi | 6.19 g/cc | 6.21 g/cc |
| at 20 tsi | 6.89 g/cc | 6.97 g/cc |
| Green strength, compressed | | |
| at 12 tsi | 277 psi | 305 psi |
| at 20 tsi | 641 psi | 832 psi |

The foregoing samples were tested on a 15 gram porous iron test bar composed 99 parts iron powder, 1 part graphite, and 1 part zinc stearate lubricant compacted to 5.85 g/cc. These test bars were then infiltrated with 5 gram slugs produced from infiltrating composition samples C and H above. The slugs were compacted to a density of about 6.80 g/cc. The tests were conducted in a best furnace pre-heated to 1100° F. and then to a high heat of 2060° F. The test parts were held for 40 minutes in the high heat zone at a dew point of 44° F. in an endothermic atmosphere.

TEST RESULTS

| | Sample C | Sample H |
|---|---|---|
| Number of samples | 5 | 8 |
| Adhesion | none | none |
| Erosion | very slight | slight |
| Efficiency | 87.6% | 90.4% |
| Dimensional change | −.12% | +.06% |
| Infiltrated density | 7.47 g/cc | 7.53 g/cc |
| MOR (modulus of rupture) | 167 ksi | 170 ksi |

EXAMPLE 2

An infiltrating composition tested under conditions comparable to Example 1 and containing copper-manganese silicon powder but containing higher amounts silicon over 2.1% caused severe adhesion and unacceptable growth believed to be due to the high oxygen content of the Cu-Mn-Si component (32 Cu-Mn-2.1 Si). In contrast, a minor amount of silicon in the Cu-Mn-Si component such as 1.4% silicone as used in Sample H improves the efficiency of the infiltrating mixture.

EXAMPLE 3

Infiltrating material sample H was infiltrated at different dew points of 32° F. and 49° F. respectively. The compacted test bars were infiltrated as in Example 1 at 2060° F. and endothermic atmosphere with the following results. The results are based on 3 samples compacted to 6.6 g/cc.

| | | |
|---|---|---|
| Dew point | 32° F. | 49° F. |
| Adhesion | none | none |
| Erosion | very slight | very slight |

-continued

| | | |
|---|---|---|
| Efficiency | 88.4% | 87.3% |
| Dimensional change | −.49% | −.17% |
| Infiltrated density | 7.53 g/cc | 7.52 g/cc |
| MOR (modulus of rupture) | 180 ksi | 177 ksi |

The foregoing examples illustrate the advantages and versatility of the infiltrating composition to provide improved infiltrated porous iron compacted parts at a wide range of dew points, but are not intended to be limiting except as defined by the appended claims.

I claim:

1. An infiltrating composition comprising powder metal mixture on a weight percent basis:

at least about 90% copper powder having a particle size less than about 177 microns;

between about 2% and 8% iron powder having a particle size less than 20 microns;

between about 1% and 5% copper-manganese alloy powder;

between about 0.4% and 1% refractory metal oxide powder;

between about 0.3% and 0.8% stainless steel powder having a particle size less than about 150 microns; and between about 0.05% and 0.2% aluminum powder.

2. The infiltrating composition in claim 1 wherein the copper-manganese alloy powder contains up to 1.5% silicon to provide a copper-manganese-silicon alloy.

3. The infiltrating composition in claim 2 wherein the copper-manganese-silicon alloy contains between about 60 to 70 weight parts copper and 40 to 30 weight parts of manganese.

* * * * *